US006023859A

United States Patent [19]

Burke et al.

[11] Patent Number: 6,023,859

[45] **Date of Patent: *Feb. 15, 2000**

[54] SHOE SOLE WITH REMOVAL INSERT

[75] Inventors: Robert Burke, Barrie; James Russell, Markham; Gad Shaanan, Montreal; Walter Francovich, Pierrefonds; Ivan Brousseau, Montreal, all of Canada

[73] Assignee: Bata Limited, Ontario, Canada

[ * ] Notice: This patent is subject to a terminal disclaimer.

[21] Appl. No.: 09/112,461

[22] Filed: Jul. 9, 1998

Related U.S. Application Data

[63] Continuation-in-part of application No. 08/783,830, Jan. 13, 1997, Pat. No. 5,799,417.

[51] Int. Cl.[7] ..... A43B 13/12; A43B 13/18

[52] U.S. Cl. ..... 36/105; 36/28; 36/30 R; 36/100; 36/15; 36/59 R; 36/36 R

[58] Field of Search ..... 36/105, 28, 30 R, 36/35 R, 100, 15, 59 R, 31, 36 R

[56] References Cited

U.S. PATENT DOCUMENTS

| | | |
|---|---|---|
| 1,640,301 | 8/1927 | Torchia . |
| 4,267,650 | 5/1981 | Bauer . |
| 4,316,335 | 2/1982 | Giese et al. . |
| 4,364,188 | 12/1982 | Turner et al. . |
| 4,377,042 | 3/1983 | Bauer . |
| 4,573,279 | 3/1986 | Feurer-Zogel et al. . |
| 4,616,431 | 10/1986 | Dassler . |
| 4,624,061 | 11/1986 | Wezel et al. . |
| 4,674,204 | 6/1987 | Sullivan et al. . |
| 4,680,875 | 7/1987 | Danieli . |
| 4,771,554 | 9/1988 | Hannemann . |
| 4,897,936 | 2/1990 | Fuerst . |
| 4,942,677 | 7/1990 | Flemming et al. . |
| 5,077,916 | 1/1992 | Beneteau . |
| 5,127,170 | 7/1992 | Messina . |
| 5,152,081 | 10/1992 | Hallenbeck et al. . |
| 5,175,946 | 1/1993 | Tsai . |
| 5,187,883 | 2/1993 | Penney . |
| 5,212,878 | 5/1993 | Burke et al. . |
| 5,224,280 | 7/1993 | Preman et al. . |
| 5,255,451 | 10/1993 | Tong et al. . |
| 5,343,637 | 9/1994 | Schindler . |
| 5,410,821 | 5/1995 | Hilgendorf . |
| 5,533,280 | 7/1996 | Halliday . |
| 5,628,128 | 5/1997 | Miller et al. . |
| 5,649,374 | 7/1997 | Chou . |
| 5,799,417 | 9/1998 | Burke et al. . |

FOREIGN PATENT DOCUMENTS

| | | |
|---|---|---|
| 1323755 | 11/1993 | Canada . |
| 4329186 | 8/1993 | Germany . |
| 2203025 | 10/1988 | United Kingdom . |
| 341706 | 10/1921 | WIPO . |
| 3612545 | 10/1987 | WIPO . |
| 9505099 | 2/1995 | WIPO . |
| 9746127 | 12/1997 | WIPO . |

OTHER PUBLICATIONS

Saz Sport Publication, published Jul. 28, 1997, 5 pages.

*Primary Examiner*—Ted Kavanaugh
*Attorney, Agent, or Firm*—Birch, Stewart, Kolasch & Birch, LLP

[57] ABSTRACT

A sport shoe having an upper, a sole having at least an outer sole having a mobile portion at least at the heel portion of the sole which is pivotable about a lateral axis forward of the heel portion. A midsole insert member is insertable between the mobile portion and the upper. The mobile portion includes upper engaging projections cooperating with the upper to prevent the midsole insert from moving laterally relative to the upper when the midsole insert member is introduced between the mobile portion and the upper.

5 Claims, 4 Drawing Sheets

10
12
44
33
38
38
46
24
20
42
30
30
14
18
16

29
42
32
33
20
48
22
38
44
12
32
46
27
26
31
42
33
24
28
30
33
14

SHOE SOLE WITH REMOVAL INSERT

CROSS-REFERENCE TO RELATED APPLICATION

This application is a continuation-in-part application of U.S. patent application Ser. No. 08/783,830, filed Jan. 13, 1997.

BACKGROUND OF THE INVENTION

1. Field of the Invention

The present invention relates to sport shoes, and more particularly, to replaceable inserts for the sole of a sport shoe.

2. Description of the Prior Art

The sport shoe has reached a high level of development in the last twenty years. The basic running shoe, including a relatively soft upper and elastomeric sole, has been fine-tuned to a great degree of specialization. A specific shoe is now available for every sport. Within the sport of running, different designs can be found, whether for jogging or running marathons. Within such specialization, a different shoe can be found for a heavy male runner or for a light female runner. A sole design can also be found for someone who requires support against over-supination or over-pronation.

Such specialization of sport shoe designs has led to a large spectrum of different shoes. For instance, if an amateur runner wishes to go for a light jog of only a few kilometers, he cannot wear his pair of running shoes designed for racing. The heel cushion in the racing shoes will have a greater durometer hardness because the shock to be absorbed will be naturally greater than what is required for a light run. In the latter case, the runner will experience some discomfort since the heel will appear to be too hard. Likewise, a softer heel portion of the heel will seem too soft for a hard competitive run.

In order to satisfy all different types of running, a person would need to own several pairs of running shoes, much like a golfer requires a set of different clubs for use with different approach shots. However, running shoes are relatively expensive, and such a solution is not practical for the average runner.

Replaceable sole inserts have been contemplated for sport shoes. Examples of such shoes are described in U.S. Pat. No. 4,624,061, issued Nov. 25, 1986 to Wezel et al; U.S. Pat. No. 4,942,677, issued Jul. 24, 1990 to Flemming et al; U.S. Pat. No. 4,897,936, issued Feb. 6, 1990 to Fuerst; and U.S. Pat. No. 5,533,280, issued Jul. 9, 1996 to Halliday.

The above patents describe various methods of replacing different inserts in the sole of a shoe. In particular, U.S. Pat. No. 4,942,677 describes the use of damping plates in the heel portion of the sole for the purposes of damping the shock absorbing characteristics of the shoe. This patent includes an outsole hinged to the remainder of the sole, and wedge-shaped damping elements are inserted between the outer sole and the upper to provide proper damping or spacing in order to enhance the height of the person wearing the shoe.

U.S. Pat. No. 4,942,677 shows a structure that is best suited for more rigid dress shoes, not modern day sport shoes. Sport shoes generally have a much softer construction. A sport shoe sole constructed with a heel and replaceable insert as found in U.S. Pat. No. 4,942,677 would tend to be plagued with lateral instability since there is no structure illustrated in the patent to resist the shear forces that might occur in a more violent side sliding movement, such as in basketball or tennis.

SUMMARY OF THE INVENTION

It is an aim of the present invention to provide an improvement to the type of sport shoe construction that permits replaceable sole inserts.

It is a further aim of the present invention to provide a sport shoe construction that includes a removable heel insert with improved lateral stability.

It is a further aim of the present invention to provide a sport shoe with a sole having a heel with a replaceable insert that is easily manipulated for a quick change of inserts.

A construction in accordance with the present invention includes a sport shoe having an upper, a sole, at least an outer sole, comprising a toe portion, a metatarsal portion, and a heel portion, the outer sole having a mobile portion at least at the heel portion of the sole being pivotable about a lateral axis, a midsole insert member insertable between the mobile portion and the upper, the mobile portion including upper engaging projections cooperating with the upper to prevent the midsole insert from moving laterally relative to the upper when the midsole insert member is introduced between the mobile portion and the upper.

More specifically, attachment means are provided to secure the mobile portion to the inner sole and sandwich the midsole insert therebetween, and cooperating projection extending between the mobile portion and the midsole insert to restrain at least the mobile portion against lateral movement.

In a more specific embodiment of the present invention, the midsole insert and the outer mobile sole member each have upstanding side walls which, when in place, abut against the upper to provide lateral stability to the midsole insert and the outer mobile sole portion.

In a yet more specific embodiment of the present invention, the upper and the midsole insert include cooperating ribs and grooves having longitudinal components so as to enhance the lateral stability of the midsole insert and the upper when the midsole insert is assembled.

In a still further embodiment of the present invention, the forefoot of the sole is provided with a mobile outer sole portion attached to the plantar area of the toe portion so that the mobile outer forefoot sole is hinged in the same manner as the mobile outer heel sole, and a midsole insert can be retained between the mobile forefoot outer sole and the inner sole of the forefoot of the shoe, which will include the metatarsal portion of the shoe.

Other embodiments have been contemplated, including attaching a full-length outsole attached to the toe portion of the upper so that the outsole may be hinged to allow the midsole insert for the forefoot portion as well as the heel portion. A pair of midsole inserts may be provided, including separate forefoot and heel midsole inserts maintained by the full-length outsole member that may be hinged at the toe portion of the upper and removably retained on the sides of the upper.

Thus, it can be seen that the construction of the present invention has improved stability, and particularly lateral stability, as compared to the prior art. All of the components that can move, such as the midsole insert and the outer mobile sole portion, have upward projections when assembled, including side walls, which overlap one another against the sides of the upper to provide lateral stability.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 4:
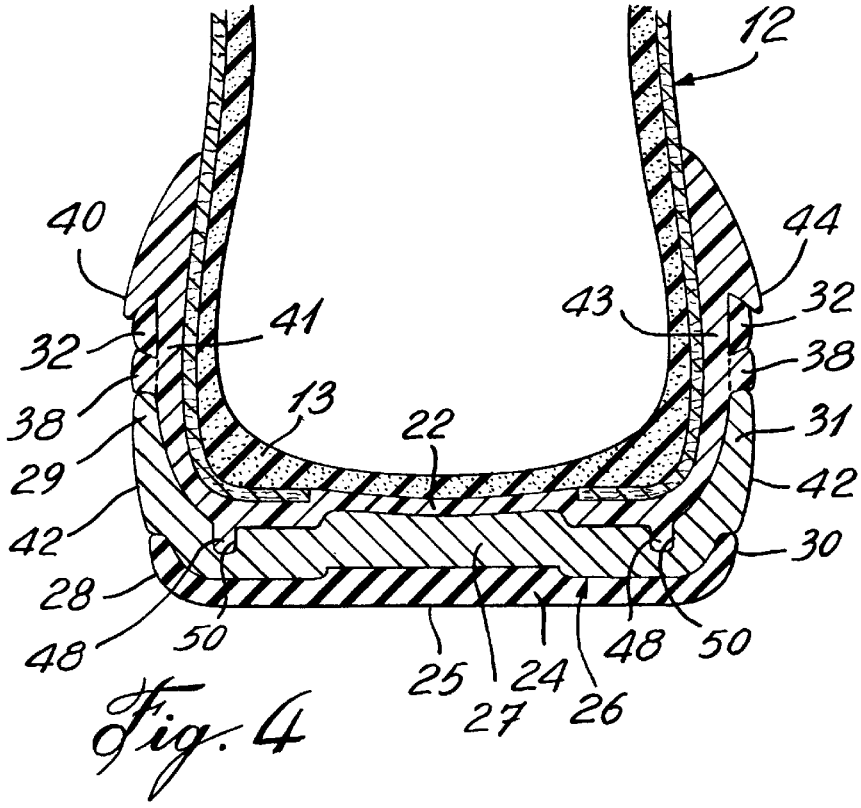
FIG. 4 is a vertical cross-section, taken along line 4—4 of FIG. 3.

The drawings show a typical sport shoe 10. The sport shoe 10 has an upper 12, a sole 14, and an inner liner 13, as seen in FIG. 4. Generally, the sport shoe has a toe portion 16, a metatarsal area 18, and a heel portion 20.

Figure 1:
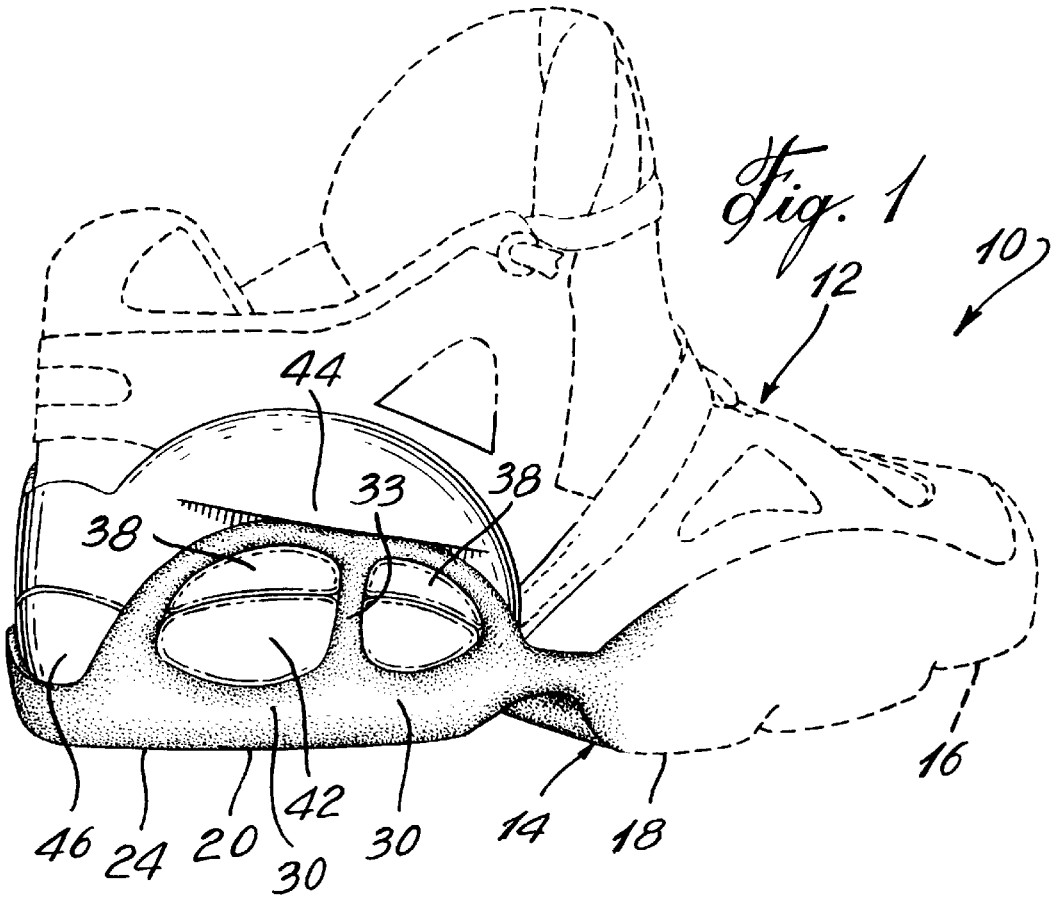
FIG. 1 is a perspective view showing a sport shoe including the present invention.
Figure 2:
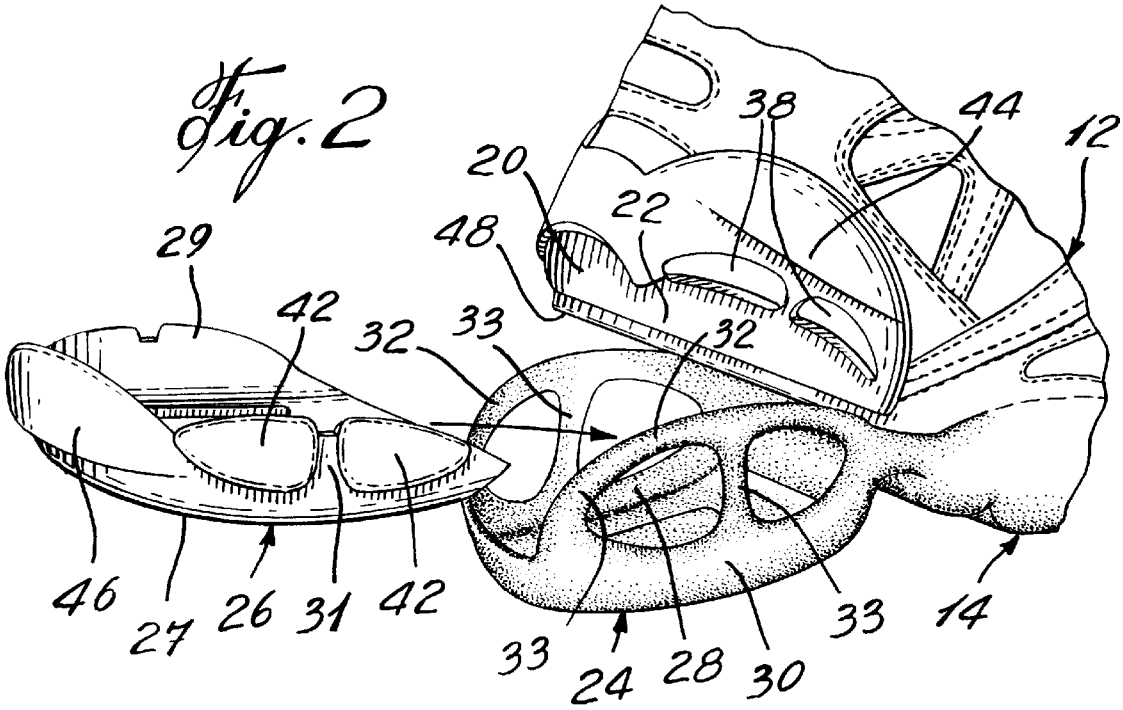
FIG. 2 is a fragmentary perspective view showing a detail of the present invention in a different operative position.
Figure 3:
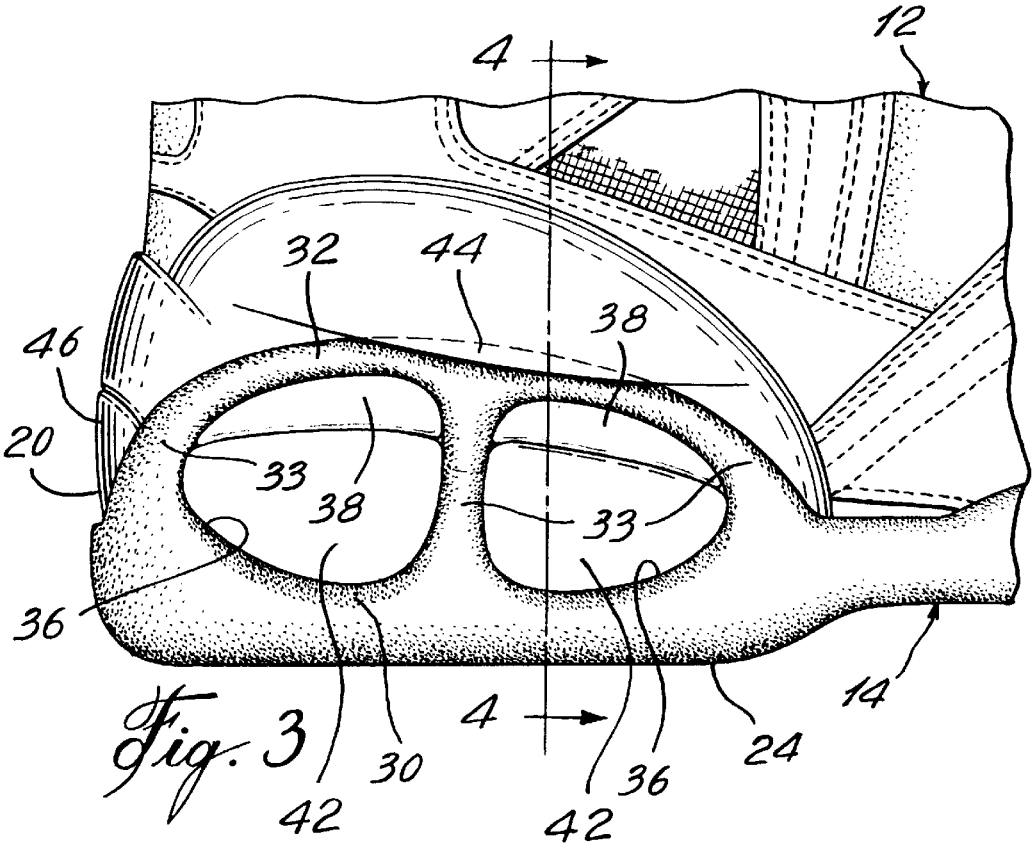
FIG. 3 is an enlarged fragmentary side elevation of the present invention.

The sole 14 is made up of a heel counter 22, as seen in FIGS. 2 and 4, and a mobile outer sole segment 24, in the area of the heel 20. The remainder of the outer sole is fixed as part of the sole, and thus the mobile outer sole segment 24 is permitted to hinge about an axis extending laterally of the sole in the metatarsal area because of the flexibility of the material of the sole. The sole is generally an elastomeric material.

The heel counter 22 may be made of a separate molded plastic material. It may be formed as a cup which is glued or otherwise fixed to the upper, as shown in FIGS. 2 and 4, for instance.

A midsole insert 26 is insertable at the heel 20 between the mobile outer sole 24 and the heel counter 22. The mobile outer sole 24 acts as a cage to retain the midsole insert 26 in position, as will be described.

The midsole insert 26 may vary in terms of durometer hardness depending on the weight of the user and the type of exercise contemplated. The midsole insert may be made of a polyurethane material of varying densities. Other suitable materials, such as silicone based TPR, may also be used. The midsole insert can also be formed to correct over-pronation or over-supination. In other words, the midsole insert 26 can have different thicknesses or different densities at the inner portion and outer portion thereof. It is also contemplated to have a midsole insert 26 with different damping characteristics in different areas of the midsole and could also be made of different materials with different characteristics.

The mobile outer sole segment 24 is provided with a bottom wall 25 and upstanding side wall portions 28 and 30. These upstanding side walls 28 and 30 include large openings 36 on either side wall 28 or 30. The openings 36 define upstanding columns 33 and a top member 32.

The midsole insert 26 includes a bottom wall 27 and side walls 29 and 31. The side walls 29 and 31 have lateral projections 42 which correspond to the openings 36 in the side walls 28 and 30 of the mobile outer sole 24. In fact, the projections 42 correspond to the lower portion of the openings 36, the upper portions of these openings being filled by the ledges 38 on the upstanding side walls 41 and 43 which project upwardly from the heel counter 22. Overlapping projections 40 and 44 are also provided on the upstanding walls 41 and 43 of counter 22, and are adapted to overlap the top member 32 of the mobile outer sole 24 when it is fixed in place. A projection 46 extends rearwardly of the midsole insert 26, as shown in the drawings, and mates with corresponding portions of the mobile outer sole 24 and the heel counter 22.

A U-shaped rib 48 is molded in the heel counter 22 and projects downwardly, as shown in FIGS. 2 and 4. A corresponding mating U-shaped groove 50 is defined in the bottom wall 27 of the midsole insert 26 to receive the rib 48, as shown in FIG. 4.

In operation, when it is required to provide a selected midsole insert 26, the shoe is in the position as shown in FIG. 2. Thus, a midsole insert 26 is selected, depending on the runner's particular needs, and is placed between the mobile outer sole segment 24 and heel counter 22 with the rib 48 located within the groove 50. The mobile outer sole 24 would then be closed over the midsole insert 26, and the member 32, of mobile outer sole 24, would be clamped into the space between the ledges 38 and the overlapping retainer members 40 and 44 respectively. Likewise, the lateral projections 42 on the upstanding side walls 29 and 31 of the midsole insert would project out of the openings 36, filling out the space of opening 36 with the ledges 38. Projection 46 would also fill out the space left at the rear of the shoe.

Thus, a secure and laterally stable assembly would result since the rib 48 engages the groove 50 in the midsole insert 26 while the midsole insert has upstanding side walls 29 and 31 abutting against the sides of the heel counter 22. The mobile outer sole 24 also has upstanding side walls 28 and 30 which engage against the upstanding side walls 29 and 31 of the midsole insert 26 and the side walls 41 and 43 of the heel counter 22.

Figure 5:
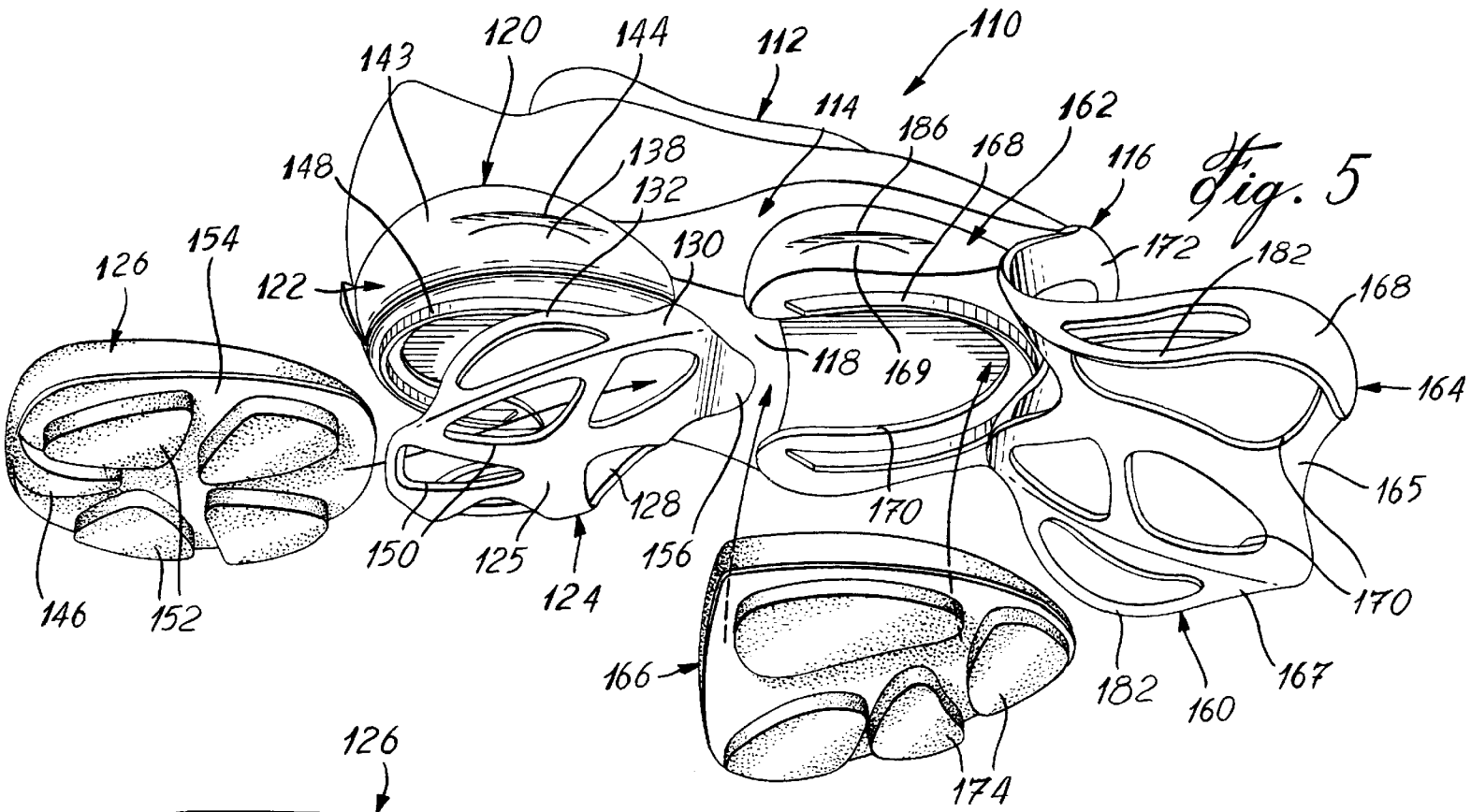
FIG. 5 is a perspective view, taken from the bottom of another embodiment of the invention, showing various elements in a first operative position.
Figure 6:
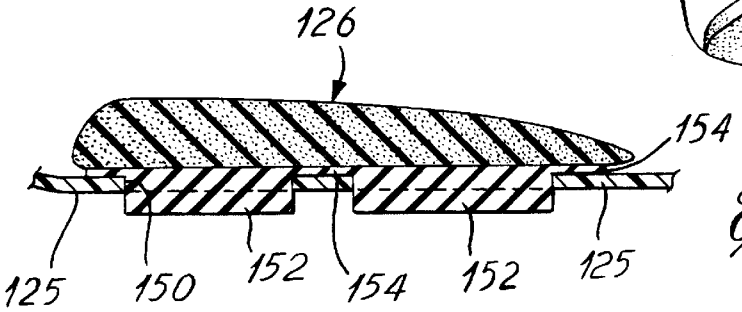
FIG. 6 is a fragmentary, enlarged, vertical cross-section taken through a portion of the sole of FIG. 5, showing a particular feature of the embodiment shown in FIG. 5 when the elements are in a second operable position.

Referring now to the embodiment shown in FIGS. 5 and 6, all of the reference numerals identifying elements which correspond to the elements in FIGS. 1 to 4 have been raised by 100.

The sport shoe 110 is shown having an upper 112 and a sole 114.

Starting with the heel portion 120, there is shown a counter 122 which is an injection-molded U-shaped cup having side walls 141 and 143 and a horseshoe rib 148 on the bottom surface thereof. In this embodiment, the mid-sole insert 126 is shown having an elastomeric wear-sole 154 glued to the insert 126. The wear-sole includes lugs 152 which project downwardly therefrom. The mobile outer sole member 124 is similar to the mobile outer sole member 24 of the embodiment shown in FIGS. 1 through 4 but includes openings 150. As shown in FIG. 6, once the mid-sole insert 126 is in position between the mobile outer sole 124 and the counter 122, the lugs 152 will project through the openings 150 in the mobile outer sole 124.

This has a great advantage in that once the lugs are worn out, it is merely the inserts that must be changed and not the complete sport shoe. Generally, serious runners become attached to a particular running shoe, but the running shoe must be discarded after a short period of time because of excessive wear on the wear-sole. By providing the wear-sole 154 on the mid-sole insert 126, as shown in the embodiment of FIGS. 5 and 6, the upper and generally the shoe can be continued to be worn, and as the wear-soles wear out, they are exchanged for newer ones along with the mid-sole insert.

The embodiment in FIG. 5 also shows a mid-sole insert 166 to be provided in the forefoot portion of the sport shoe. Thus, an injection-molded cup 162, similar to the counter 122, is located in the metatarsal and toe area and glued to the upper. The cup 162 would also have, a rib 168 for engaging with a mating groove in the mid-sole 166 (not shown). The horseshoe-shaped edge 170 of the cutout portion in the cup 162 can also mate with a similar projection (not shown) on the mid-sole insert 166.

Thus, the mobile outer sole 160, which includes a lower wall 165, openings 170, adapted to receive the lugs 174 on the mid-sole 166, also includes upstanding side walls 167 and 168 with members 182 adapted to be engaged in the hook-like ledge 169 on the cup 162. The overhanging ledge 186 on the cup 162 will also retain the member 182.

Figure 7:
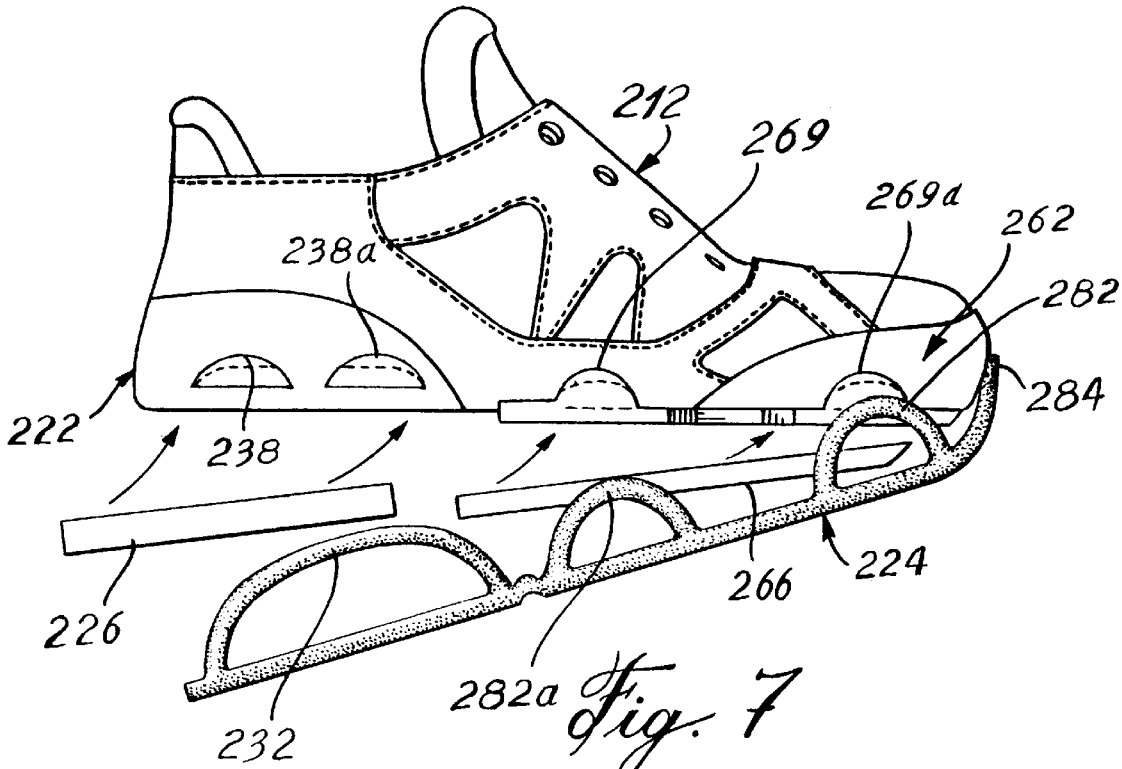
FIG. 7 is a side elevation of yet another embodiment of the present invention wherein the elements are in a first operative position.
Figure 8:
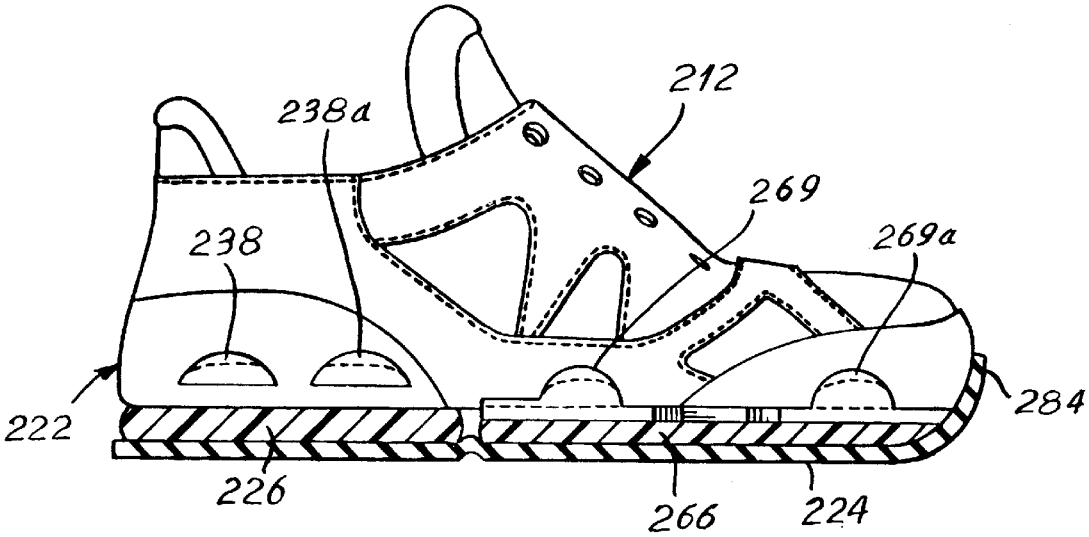
FIG. 8 is a side elevation, partly in cross-section, showing the elements in their second and useful operative position.

FIGS. 7 and 8 show yet another embodiment in which the elements corresponding to the elements in FIGS. 5 and 6 have been raised by 200.

The sport shoe in FIGS. 7 and 8 is shown schematically where the mobile out-sole 224 is a one-piece member which covers both the heel area 220 and the toe area. In this case, the mobile out-sole 224 would be fixed to the upper at the toe portion where indicated at 284. The mid-sole inserts 226 and 266 are similar to those shown in FIGS. 1 to 4 or the embodiment of FIGS. 5 and 6 but are shown here schematically. They would be held against the counter 222 and the cup 262 by means of the members 232 and 282 and will engage the hook-like projections 238, 238*a*, 269, and 269*a* in the same manner as that described with the earlier embodiments.

We claim:

1. A sport shoe comprising an upper, a sole having at least an outer sole, and comprising a toe portion, a metatarsal portion, and a heel portion, the outer sole having at least one mobile portion being hinged about a lateral axis forward of the heel portion for movement between a closed position and an open position, and at least one interchangeable sole insert insertable between the at least one mobile portion and the upper, the at least one mobile portion includes releasable upper attachment members for releasably securing the at least one mobile portion to complementary attachment members on the upper whereby the at least one interchangeable sole insert will be held between the at least one mobile portion and the upper when the at least one mobile portion is in the closed position, and complementary convex and concave engaging projections provided on the at least one sole insert, the at least one mobile portion, and the upper in order to prevent the sole insert from moving laterally relative to the upper when said mobile portion is in the closed position.

2. The sport shoe as defined in claim 1, further comprising a wear-sole mounted to the plantar surface of each sole insert, the wear-sole being provided with ground engaging lugs extending from the wear-sole, and wherein the mobile outer sole portion is provided with openings corresponding to the ground engaging lugs such that, when the sole inert is mounted between the mobile outer sole and the upper, the ground engaging lugs project through the openings in the mobile outer-sole portion.

3. The sport shoe as defined in claim 1, wherein the mobile portion of the outer sole is pivotable about a lateral axis forward of the toe portion and a second mid-sole insert is insertable at the toe and metatarsal portion of the sole between the mobile outer sole and the upper in addition to the sole insert at the heel portion thereof.

4. The sport shoe as defined in claim 1, wherein the mobile portion is hinged about a lateral axis at a forward section of the toe portion, and the mobile portion extends rearwardly to include the metatarsal portion and the heel portion, and a pair of interchangeable sole inserts are provided, one at the heel portion and the other plantar to the toe and metatarsal portion.

5. The sport shoe as defined in claim 1, further comprising a second mobile portion plantar to the toe and metatarsal portions of the sole and pivotable about a lateral axis forward of the toe portion, and a second mid-sole insert member insertable between the second mobile portion and the upper such that selective mid-soles can be utilized for both forefoot and heel portion of the sole of the sport shoe.

* * * * *